United States Patent [19]

Lu

[11] 4,192,902

[45] Mar. 11, 1980

[54] IN SITU COATING THEN SPRAY DRYING OF MAGNETIC TONER

[75] Inventor: Chin H. Lu, Webster, N.Y.

[73] Assignee: Xerox Corporation, Stamford, Conn.

[21] Appl. No.: 792,635

[22] Filed: May 2, 1977

[51] Int. Cl.[2] ..... B05D 5/12

[52] U.S. Cl. ..... 427/127; 427/215; 427/216; 427/221; 427/346; 427/409; 427/435; 427/58; 427/87; 427/130; 427/131; 427/214; 427/107; 252/63.5; 427/372.2; 427/383.7; 427/407.1; 427/430.1

[58] Field of Search ..... 427/127, 346, 215, 216, 427/220, 372 R, 383 C, 221, 407 R, 409, 430, 435; 252/62.1 P

[56] References Cited

U.S. PATENT DOCUMENTS

| | | | |
|---|---|---|---|
| 3,790,407 | 2/1974 | Merten et al. | 117/240 |
| 3,922,381 | 11/1975 | Datta | 427/21 |
| 3,928,220 | 12/1975 | Slusarczuk | 252/62.62 X |
| 3,947,370 | 3/1976 | Miller | 252/62.1 P |
| 3,973,948 | 8/1976 | Laferty | 427/215 X |
| 3,996,392 | 12/1976 | Berg et al. | 428/900 |
| 4,075,391 | 2/1978 | Berg et al. | 428/900 |

OTHER PUBLICATIONS

Chemistry of Organic Compounds, Noller, pp. 151 & 156

*Primary Examiner*—Bernard D. Pianalto
*Attorney, Agent, or Firm*—J. J. Ralabate; E. O. Palazzo; R. A. Gerlach

[57] ABSTRACT

A method of toner formation wherein a dispersion of magnetic pigment, resin, solvent and surfactant is spray dried to form the toner particles. Two preferred processes are disclosed: (1) A dispersion of magnetite, resin, fatty acid, and solvent is prepared by high speed agitation. The dispersion is then spray dried to form toner particles. (2) A dispersion of magnetite, fatty acid and solvent is subject to reflux heating, followed by addition of resin solution prior to spray drying to form toner particles.

26 Claims, 2 Drawing Figures

IN SITU COATING THEN SPRAY DRYING OF MAGNETIC TONER

BACKGROUND OF THE INVENTION

This invention relates to formation of toner for electrophotographic development utilizing magnetic toner particles which are applied from magnetic brush to the electrostatic latent image without use of a carrier material.

A vast majority of the electrographic copying processes in use today involve creation on a suitable recording medium of an electrostatic charge pattern corresponding to a pattern of light and shadow to be reproduced and the development of that pattern by deposition of marking material on the recording medium according to forces generated by such electrical potential pattern. Xerography is the most widely known of these techniques. The substrate may be photoconductive, such as in the case of selenium as taught in Carlson's U.S. Pat. No. 2,297,691, or may be a conventional insulating substrate overlying a photoconductor layer, as described in Watanabe, U.S. Pat. No. 3,536,483, to name a few examples.

After creation the electrical potential pattern is generally developed by means of a finely divided developer powder thus giving form to the hitherto latent electrostatic image. In a common technique a fine, insulating, electroscopic powder is cascaded over the electrical potential pattern bearing member. The powder is, in the conventional use, triboelectrically charged to a definite polarity and deposits preferentially in regions of the surface where there is a preponderance of charge of the opposite polarity. The triboelectric charge is caused by presence of carrier beads in the powder mix. This technique of development is called cascade development.

In another form of cascade development, called magnetic brush development magnetic carriers are employed. In this technique a magnetic force is used to provide adherence of the toner-carrier mixture to a support member which is then presented to the image bearing member. In comparison to cascade develop-magnetic brush development fills in solid areas better, is more compact, and does not depend on gravity to present the toner to the surface, a factor which allows freedom in locating the developer station.

In yet another form of electrostatic charge pattern development, a conductive one-component toner is used by bringing a conductive support member bearing a layer of fine conductive toner powder into contact with the charge pattern bearing member as in U.S. Pat. No. 3,166,432 to Gundlach. In this case the toner is held to the support member by van der Waal's forces and the conductive support member is held at a bias potential during development. This technique fills in solid areas and requires only one component in the developer material.

A further method of developing an electrostatic charge pattern is to employ an electroscopic toner suspended in a liquid. With the proper choice of materials, the toner becomes charged to a definite polarity when dispersed in the liquid. When the electrostatic charge pattern bearing member is brought into contact with the liquid suspension, the toners deposit where there is a preponderance of charge of the opposite polarity as in cascade development.

While all of the above techniques have certain advantages in particular situations, each one suffers from disadvantages which impair their utility in actual machines.

In the conventional cascade development technique the toner-carrier combination has a definite charge polarity and is not reversible without changing the toner or the carrier. Thus, positive and negative developed images cannot easily be made. Also the images are hollow and solid areas are not filled in resulting in low-fidelity development compared to the original charge pattern. The triboelectric properties of the toner, while necessary to development, cause severe problems. Uneven charging of the toners causes backgrounding as do the uneven forces between carrier and toner result in varying threshold levels from toner to toner. Also, since the toner retains its charge for long periods of time, during cascading some toners escape the development region and enter other parts of the apparatus causing mechanical problems. These problems, coupled with the inherent problems of using a two-component system where only one component is depleted, definitely limit the utility of such techniques.

The magnetic brush development, as it also uses carrier, suffers from some of the above mentioned disadvantages although it overcomes others. As mentioned above, this technique is less efficient but helps to fill in solid areas. However, it still requires triboelectric toners, which have the concomitant problems mentioned above. Also, due to the mechanical brushing action and other electrical characteristics, this technique usually results in high background deposition and poor machine latitude.

The process described in Gundlach, U.S. Pat. No. 3,166,432, has many advantages over the above mentioned cascade type techniques. However, it suffers from drawbacks which limit its applicability. The van der Waal's forces, which act to adhere the toner onto the conductive support member, are a counterforce to the image producing electric force generated by the electrostatic charge pattern, and as such must be selectively overcome to have toner deposited. The van der Waal's forces are weak and non-uniform from one toner to the next. Also high contrast is difficult to achieve. The fact that the van der Waal's forces are not under direct control but subject largely to the surface properties of the materials involved makes the system highly susceptible to alteration of development properties upon wearing of the involved surfaces or variations in ambient conditions of temperature and humidity.

In a liquid development technique most of the problems of cascade development are present in addition to other unique to a liquid system. The technique requires triboelectric charging, making image reversal difficult as explained above. Also, as in the case of cascade development, the charge on a given toner is not well controlled, resulting in high background deposition, poor machine latitude, and a characteristic splotchiness in large dark or grey areas. The inherent problems of the handling liquids, usually solvents, in a machine are also present.

There have been suggested systems for magnetic development not utilizing the carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

A further development of magnetic development without carriers is illustrated by Kotz, U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers the disadvantages that it does not transfer well from a photoconductive substrate to plain bond paper. The Nelson toner further must be formed by a difficult process of many steps.

Therefore there is a continuing need for magnetic toners suitable for use in one component magnetic development systems. There is a need for toners suitable for high speed development that also have good electrostatic transfer characteristics for transfer from a photoconductive surface to plain bond paper. There is further a need for a method of making a field dependent toner by a simple process. There is a need for toners which after they are transferred to paper adhere sufficiently well by electrostatic forces that image disturbances (blur) do not readily occur on handling the unfused toner image prior to fixing.

SUMMARY OF THE INVENTION

It is an object of this invention to provide a process of producing toner overcoming the above noted deficiencies.

It is a further object of this invention to provide a process of toner manufacture by a simple process that overcomes the deficiencies of the above noted processes.

It is another object of this invention to produce clear sharp images by magnetic development using a magnetic toner without using a carrier.

It is a further object to produce a toner that will transfer electrostatically from the photoreceptor to plain bond paper.

It is another additional object to produce a low cost coated pigment containing toner whose electrical resistivity is field dependent.

It is a still further object to produce toner that does not blur when the paper it has been transferred to is moved.

It is still an additional object of this invention to form toners by a simple process.

These and other objects of the present invention are accomplished by spray drying a dispersion formed of magnetic particles, resin and a surfactant. In the first method magnetic particles may be coated with the surfactant by high speed agitation of a dispersion of the magnetic particles, resin, and surfactant in a solvent. The dispersion is then spray dried to form the toner particles. The second method involves the formation of a dispersion of magnetic particles and surfactant in solvent followed by reflux heating during agitation of the dispersion. After reflux heating a solvent and resin solution is mixed into the dispersion and it is spray dried.

In a specific embodiment in accordance with the instant invention fifty parts by weight magnetite, 2 parts by weight stearic acid in toluene were mixed and heated to about 110° C. for about 1 hour with reflux and agitation. After heating the mixture is blended with a polymer solution containing a 50 parts styrene polymer in toluene. The dispersion was then spray dryed to form a toner. The toner is found to have a powder resistivity of about $10^{17}$ ohm-cm at low field strength.

DESCRIPTION OF THE INVENTION

Figure 2:
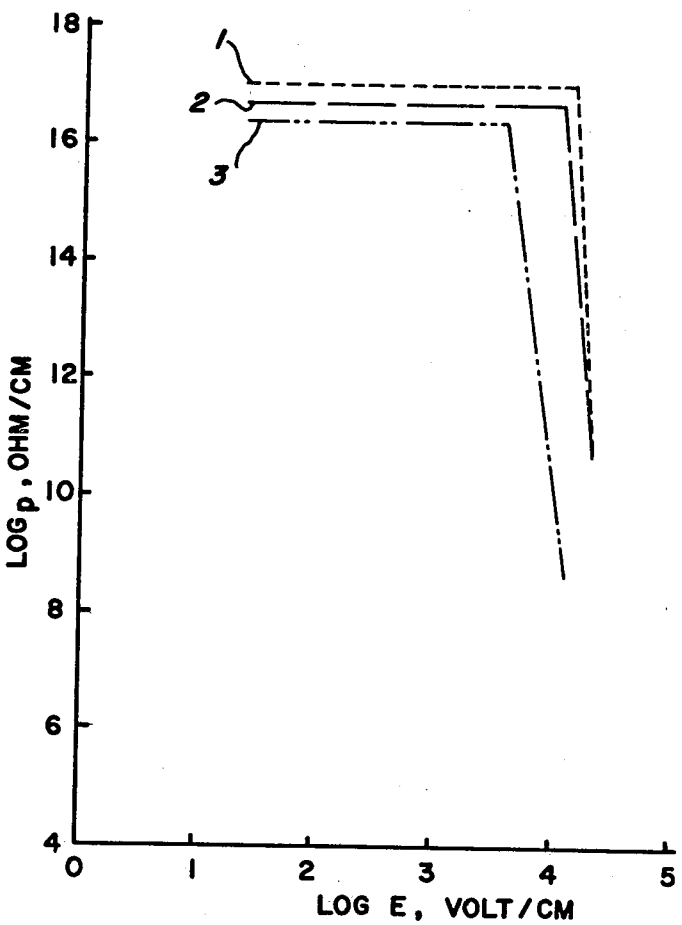
FIG. 2 illustrates the resistivity verses electrical field strength of three toners produced by the high speed agitation (first process) with different concentrations of stearic acid.

The toners formed by the process of the instant invention generally have resistivity that is field dependent on the strength of the electrical field. They have a powder resistivity of about $10^{17}$ ohm-cm at low field and are relatively conductive at high fields and resistive at low fields. The great field dependent resistivity change of these toners allows transfer of the toner by the customary electrostatic transfer processes without use of specially treated paper or transfer techniques such as pressure or use of adhesives. Further the toner is conductive at high fields so as to easily develop by magnetic techniques.

The toners formed by the process of the instant invention have a resistivity of greater than about $10^{12}$ ohm-cm at low fields of about 10 volt/cm which corresponds to about 1 log E volt/cm as used in the drawing. It is preferred that the high resistivity of greater than about $10^{12}$ ohm-cm be maintained at at least up to about 100 volt/cm field strength which corresponds to about 2 log E volt/cm in the drawing to give greater transfer latitude. The preferred initial resistivity is greater than $10^{14}$ ohm-cm which of course corresponds to about 14 log E ohm-cm on the drawing as the range allows good development of the electrostatic image. The toners of the method of the invention display a substantially stable resistivity as field strength increases and then have a sharp break point where the resistivity rapidly decreases at a slope of greater than about 5 when plotted as the log of powder resistivity (ohm-cm) versus log of the field in volt/cm. The preferred slope is greater than about 10. Generally the slope is about 10 to 20 for toners formed by the invention. The slope greater than about 10 is preferred as it results in excellent electrostatic transfer and also good development.

The toners formed by the methods of the instant invention are referred to as magnetic because they are attracted to a magnet. They are not themselves magnets. The toners are held to a magnetic brush, roller or belt by magnetic forces. The brush is biased to induce a charge, opposite to that carried by the photoreceptor, into the toner particles. Then the outer particles develop the electrostatic image as the electrostatic forces overcome the magnetic forces to deposit toner in the image areas. The earlier referenced U.S. Pat. No. 3,909,258 has illustrations of the forces present in the developing processes utilizing a magnetic brush system without a carrier.

The drawings illustrate the resistivity versus electrical field strength of a toner produced using the method of the instant invention. While specifically representing the Example I toner, FIG. 1 also generally represents properties of toners produced by the method of the invention. As illustrated the toners formed by the invention have a high resistivity of greater than $10^{14}$ ohm-cm that remains substantially the same as the electrical field strength is increased to about 3 log E volt/cm at which a sharp break occurs and the resistivity drops sharply at a slope greater than 5.

Figure 1:
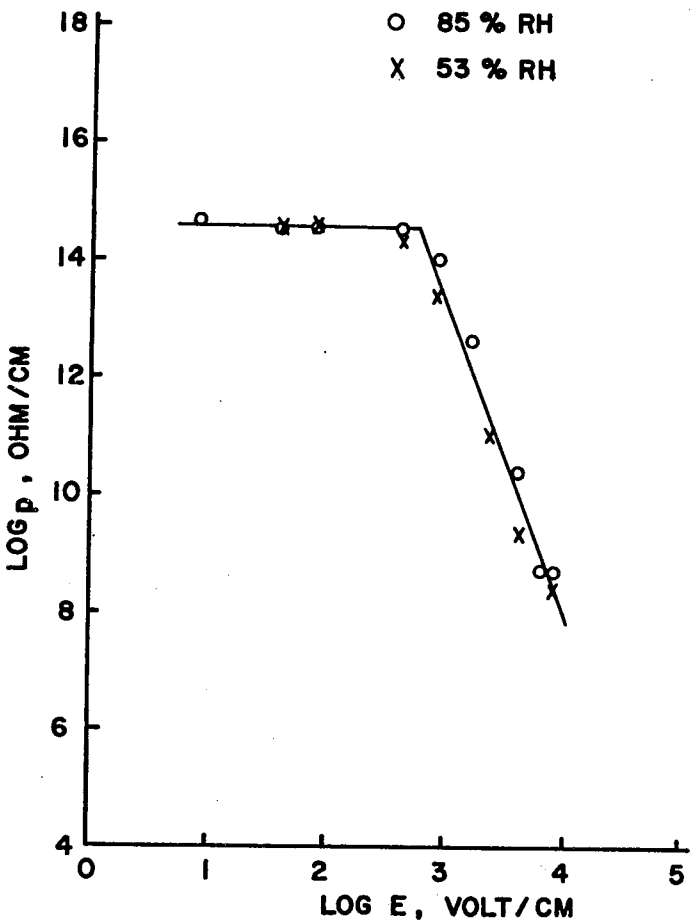
FIG. 1 illustrates the resistivity verses electrical field strength of a toner produced using the reflux heating, (second process) of the instant invention.

The toners of the instant invention,also as shown in FIG. 1, exhibit remarkable stability of properties at high humidity of 85% when compared to the normal humidity.

While not wishing to be bound by any theory as to why the instant toners display their remarkable field dependent properties it is believed that the properties are somehow related to the concentration of magnetic particles at the surface of the toner and that the coating of the magnetic pigment contributes to the higher concentration that results after spray drying. It is thought that the stability under humidity variance is related to the hydrophobic properties of the fatty acid coating or to covering of hydrophobic groups on the pigment particles.

The magnetic pigment used in the process of the invention may be any suitable particle which will give the desired magnetic properties in a toner subsequently formed. Typical of such materials are ferrites, iron particles and nickel alloys. Preferred for the instant process are magnetite particles as they are black in color, low cost and provide excellent magnetic properties. The magnetite particles or other magnetic particles may be of any shape and any size which results in a semiconductive toner particle with good transfer properties. Generally the particle size is between about 0.02 micron and about 1 micron. A preferred average particle size for the magnetite particles is about 0.1 to about 0.8 microns average particle size. The particles may be a acicular or cubic shaped. A suitable magnetite loading is between about 40 and 65 percent by weight of the completed toner. A preferred loading is between about 45 and 55 percent by weight of the magnetite to total toner for good development and transfer.

The material treating the magnetic particle may be any surfactant which is compatible with the toner resin and maintains a firm bond to the magnetic particle during mixing with a solvent for the toner resin and spray drying. The magnetite coating suitably has one moiety displaying affinity to the magnetite surface such as carboxylic, sulfate, sulfonate, phosphate, ester, alcohol, amine, amide groups, and quanternary ammonium compounds or combinations thereof and another moiety which aids dispersion such as hydrocarbon chains having 6 to 22 carbon atoms. Suitable for the invention are fatty acids and fatty acid derivatives wherein the fatty acid has 6–22 carbon atoms. Preferred are stearic acid, lauric acid, palmitic acid, myristic acid, pentadeconic acid, margaric acid, oleic acid, linoleic acid and mixtures and derivatives thereof, which have been found to have good dispersion properties and result in desirable semiconductive properties that aid in transfer. The amount of the coating on magnetite may vary between about 0.1 and 10 percent by weight. A suitable range of coating material for magnetite is about 1 to about 5 weight percent of the magnetite. A preferred range is about 2 to 3 weight percent for good insulative properties at low field.

The first method involving high speed dispersion is normally performed in a device such as a Kady mill where high speed and high shear mixing occurs. The high speed agitation is performed for a period of time necessary to effectively coat the particles with the fatty acid or other surfactant. Generally a period of about 30 minutes is satisfactory for complete coating in a reasonable time. Shorter periods also may be suitable when mixing is intense and/or a larger amount of surfactant is present. The effective time period is generally greater than about 10 minutes. Generally the agitation is such that some warming of the material takes place during agitation.

The toner resins for use in the process of the invention may be selected from any suitable toner resin material that is compatible with the coating of the magnetite.

While any suitable transparent resin possessing the properties as above described may be employed in the system of the present invention, typical of such resins are polyamides, epoxies, polyurethanes, polyesters, polycondensation products, vinyl resins and polymeric esterification products of a dicarboxylic acid and a diol comprising a diphenol. Any suitable vinyl resin may be employed in the toner of the present system including homopolymers or copolymers of two or more vinyl monomers. Typical of such vinyl monomeric units include: styrene; p-chlorostyrene; vinyl naphthalene; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be blended with one or more other resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

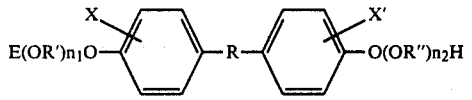

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R" represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R" represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R" are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis(4-beta hydroxy ethoxy phenyl)-propane, 2,2-bis(4-hydroxy isopropoxy phenyl)propane, 2,2-bis(4-beta hydroxy ethoxy phenyl)pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl)propane, 1,1-bis(4-hydroxy-ethoxy-phenyl)-butane, 1,1-bis(4-hydroxy isopropoxy-phenyl)-heptane, 2,2-bis(3-methyl-4-beta -hydroxy ethoxy-phenyl)propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl)propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R" represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R" are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOCR'''_{n_3}COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist and formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resin modified phenol-formaldehyde resin, oil modified epoxy resins, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. Re.25,136 to Carlson and polystyrene blends as described in U.S. Pat. No. 2,788,288 to Rheinfrank and Jones.

The solvent used for spray drying may be any material capable of dissolving the toner resin without adversely effecting the coating of the magnetite. Solvents for toner resins are well known including hydrocarbons, alcohols, ketones, esters, amides, fluorinated hydrocarbons, chlorinated hydrocarbons and other well known solvents. Preferred solvents are toluene for use with styrene polymer resins and styrene polymer blends as this results in a toner that is solvent free and the solvent is low cost and relatively non-toxic. Chloroform has been found to be a preferred solvent for use with polyester type toner resins as it is readily available, and non-flammable and results in a toner of low residual solvent. Both chloroform and toluene also are compatible with the preferred stearic acid and has a derivative coating for the magnetite. The solvent is generally used in an amount such that the solids content of the solvent slurry is 5–20% by weight. The term solids content is used here to indicate the solid resulting from spray drying which is the resin and magnetite plus any other additives to the toner such as colorants.

In the second method of the invention heating of the magnetite and fatty acid or fatty acid derivative in solvent may be carrier out for any length of time resulting in a toner having the desired field dependent properties. Generally the heating is carried out with reflux for a period of about 30 minutes to 3 hours. A preferred time of heating is about 1 hour with reflux which results in a toner having the desired field dependence without an overly long formation time period. A temperature of reflux heating is selected dependent on the volatility of the solvent being used. The heating temperature of about 100° to about 150° C. has been found to be typical for common solvents.

Any suitable spray drying equipment may be used in the formation of the toners of the instant invention. Such spray drying equipment is well known in the toner art. Generally the temperature of the spray drying is regulated to be near the boiling point of the solvent being utilized.

While the above discussion has not included the addition of additives to the solvent prior to spray drying for inclusion in the toner it is encompassed that additives such as pigments, humidity control materials and dyes may be added prior to toner formation. The preferred magnetite materials of the instant process are black and therefore suitable for the majority of electrophotographic reproduction uses without benefit of colorant additives. However other less dark colored magnetic materials might require pigment or dye additives to obtain a suitable toner color. Such pigments and dyes are not needed to obtain the field sensitivity of toners of the instant invention.

It is further contemplated that after treatment processes such as classification might be necessary depending on the particle size range achieved by the spray drying and the requirements of the system utilizing the toners.

DESCRIPTION OF THE PREFERRED EMBODIMENTS

The following Examples further define, describe and compare methods of preparing developers of the instant invention and of utilizing them in electrophotographic applications. Parts and percentages are by weight unless otherwise indicated.

EXAMPLE I

A dispersion of about 100 grams Pfizer magnetite MO-4232, an uncoated magnetite, about 4 grams purified stearic acid and about 100 grams of toluene are mixed and heated to about 110° C. for 1 hour with reflux and gentle agitation. This heating is carried out in a three-neck flask. After heating, the mixture is blended with a polymer solution containing about 96 grams of polystyrene resin (Piccolastic D-125) in about 1000 grams of toluene. The dispersion is then spray dryed to a toner of about 12 average particle size. The resulting toner had excellent field dependent characteristics. As illustrated by FIG. 1 the initial resistivity was greater than 14 ohm-cm and at a certain point dropped rapidly in resistivity. This toner also as illustrated by FIG. 1 showed very little humidity sensitivity. The toner was found to be capable of rapid development using a magnetic system without carrier and successfully transferred by electrostatic transfer at about a 75% rate of transfer efficiency. The purified stearic acid actually contains stearic acid about 88%, palmitic acid about 6%, myristic acid about 4.5% and lauric acid 1.5%.

EXAMPLE II

The process of Example I is repeated except 3 grams of the stearic acid were used. The toner displays excellent transfer properties.

EXAMPLE III

The process of Example I is repeated escept that 6 grams of a mixture of 95 parts stearic acid and 5 parts palmitic acid is substituted for the stearic acid. This toner also exhibits good electrical characteristics and electrostatically transfers very well.

EXAMPLE IV

The process of Example I is repeated except 120 grams of the magnetite are utilized and 80 grams of the resin. Further, 5 grams of a mixture of about 83 parts stearic acid, 2 parts muristic acid, 1 part pentadecanic acid and 11 parts myristic acid is substituted for the stearic acid. The toner of this example also displays excellent electrostatic transfer properties and good development characteristics.

EXAMPLE V

A toner is prepared by forming a dispersion of about 98 grams of 65/35 styrene-n-butyl-methacrylate resin, about 4 grams purified stearic acid, about 100 grams Pfizer magnetite MO-4232 and about 1100 grams of toluene in a Kady mill. The Kady mill is operated at high speed for about 30 minutes. The toner is then spray dryed to form a toner of about 12 microns average particle size. The resulting toner has excellent field dependent characteristics and is not humidity sensitive. The resistivity of this toner is given as line 2 of FIG. 2. The toner illustrates the substantially level high resistivity at low field and as the field increases a sharp break point where resistivity drops rapidly that is characteristics of toners formed by the instant method.

EXAMPLE VI

The process of Example V is repeated except that about 2 grams of stearic acid are utilized and about 98 parts of the 65/35 styrene and butylmethacrylate of Example V. This toner also is found to produce desirable field dependent properties. The resistivity of this toner is shown by line 1 of FIG. 2 in the drawings.

EXAMPLE VII

The process of Example V is repeated except that about 6 grams of stearic acid are utilized and about 94 grams of a 65/35 styrene and butylmethacrylate resin of Example V. This toner also has desirable resistivity properties and is illustrated by line 3 of drawing FIG. 2.

EXAMPLE VIII

As a control, a toner was formed by spray drying a slurry of about 104 grams uncoated Pfizer magnetite MO-4232 and 96 grams Piccolastic D/125 and about 1100 grams toluene and when tested over the same range as illustrated in FIG. 2 the toner only varies between about $10^{16}$ and $10^{17}$ ohm-cm. The toners of the invention in contrast vary between about $10^{14}$ ohm-cm at a low field strength of about 40 volts/cm and a resistivity of less than about $10^{8}$ ohm-cm at a field strength of greater than 8000 volts/cm.

The resistivity measurements for toner used throughout this application are determined by the following process. Measurements on powder are complicated by the fact that the results are influenced by characteristics of the powder particles, shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volumn is reached. The current is measured as a function of applied voltage at the 50 mil gap. The electrification time is 1 minute as recommended by ASTM method. Resistivity is calculated according to Ohms law and the data as presented in the figures is as a Log of resistivity versus Log of field strength.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used in the formation process of the present invention other steps or modifications may be used. For instance the toner could be classified after formation. In addition other materials such as colorants or tribo control agents could be added.

The transfer efficiency of the toners formed by the process of the instant invention is greater than about 70 percent and generally reaches 85 percent in ordinary electrostatic transfer.

Other modifications of the present invention will occur to those skilled in the art upon reading the present disclosure. These are intended to be included within the scope of this invention. For instance, the coated magnetic particles of this invention could be utilized in formation of permanent magnets or in a paint as a magnetic coating. Further the coating method could be used to treat colored pigments for toner use to reduce humidity sensitivity.

What is claimed is:

1. A process of making a field dependent toner having a resistivity greater than $10^{12}$ ohm-cm at fields less than 100 volts/cm and less than $10^{12}$ ohm-cm at fields greater than 100 volts/cm comprising applying a surfactant to magnetic pigment particles, the surfactant being present on the magnetic pigment in an amount of from about 0.1 to 10 percent by weight of the magnetic pigment, spray drying a dispersion of the thus coated magnetic pigment particle in a solution of a resin in a solvent and recovering the toner particles thus formed.

2. The process of claim 1 wherein said surfactant is selected from the group comprising fatty acids and fatty acid derivatives.

3. The process of claim 2 wherein said pigment comprises magnetite.

4. The process of claim 3 wherein said pigment forms between about 30 and about 65 weight percent of said toner particles.

5. The process of claim 3 wherein said magnetite is present in about 45 to about 55 weight percent of said toner particles.

6. The process of claim 1 wherein said solvent comprises toluene or chloroform.

7. A process of making a field dependent toner having a resistivity greater than $10^{12}$ ohm-cm at fields less than 100 volt/cm and less than $10^{12}$ ohm-cm at fields greater than 100 volt/cm comprising forming a dispersion of surfactant and magnetic particles in a solvent, heating to reflux, adding a solution of resin and solvent, spray drying and recovering toner particles, the surfactant being present as a coating on the magnetic pigment in the amount of from between about 0.1 and 10 percent by weight based on the weight of the magnetic pigment.

8. The process of claim 7 wherein reflux heating is carried out for about 1 hour.

9. The process of claim 8 wherein said solvent comprises about 60 to about 95 weight percent of the dispersion.

10. The process of claim 7 wherein said spray drying is carried out at between about 180° F. and 220° F.

11. The process of claim 7 wherein the dispersion is agitated during the reflux heating.

12. The process of claim 7 wherein said surfactant comprises fatty acids and fatty acid derivatives.

13. The process of claim 12 wherein said fatty acids and fatty acid derivatives are selected from the group consisting of lauric, myristic, pentadecanic, palmitic, margaric, stearic, oleic and linolic acids and mixtures and derivatives thereof.

14. The process of claim 12 wherein said magnetic particles comprise magnetite.

15. The process of claim 12 wherein said solvent comprises toluene or chloroform.

16. The method of claim 7 wherein reflux heating is carried out for a time between about 30 minutes and 3 hours.

17. The process of claim 7 wherein said surfactant comprises stearic acid.

18. The method of claim 7 wherein said magnetic pigment comprises about 40 to about 65 weight percent of the completed toner.

19. The method of claim 7 wherein said toner particles recovered possess a field dependence such that at low fields of less than 10 volt/cm the resistivity is greater than $10^{12}$ ohm-cm and at some higher field they exhibit a sharp drop to a resistivity of less than $10^{8}$ ohm-cm along a line of a slope greater than 5 when log of powder resistivity is plotted versus the log of the field in volt/cm.

20. The method of claim 19 wherein said magnetic pigment is magnetite coated with a surfactant comprising a fatty acid or a fatty acid derivative.

21. The method of claim 19 wherein the said slope is greater than 10.

22. The method of claim 19 wherein said slope is between about 10 and about 20.

23. A process of making a field dependent toner having a resistivity greater than $10^{12}$ ohm-cm at fields less than 100 volt/cm and less than $10^{12}$ ohm-cm at fields greater than 100 volt/cm comprising forming a dispersion of magnetic particles, resin and surfactant, subjecting the dispersion to high speed agitation, spray drying and recovering toner particles, the surfactant being present as a coating on the magnetic pigment in the amount of from between about 0.1 and 10 percent by weight based on the weight of the magnetic pigment.

24. The process of claim 23 wherein said surfactant is selected from the group consisting of fatty acids and fatty acid derivatives.

25. The method of claim 23 wherein said magnetic pigment comprises magnetite.

26. The method of claim 23 wherein the magnetic pigment comprises about 40 to about 65 percent by weight of the completed toner.

* * * * *